US008057571B2

(12) United States Patent
Pauty et al.

(10) Patent No.: US 8,057,571 B2
(45) Date of Patent: Nov. 15, 2011

(54) CORROSION RESISTANT TOOL

(75) Inventors: Emmanuel Pauty, Echirolles (FR); Håkan Engström, Bromma (SE); Victor Rimbau, Barcelona (ES); Gerard Vasco i Salas, Barcelona (ES)

(73) Assignee: Sandvik Intellectual Property AB, Sandviken (SE)

( * ) Notice: Subject to any disclaimer, the term of this patent is extended or adjusted under 35 U.S.C. 154(b) by 998 days.

(21) Appl. No.: 12/003,202

(22) Filed: Dec. 20, 2007

(65) Prior Publication Data

US 2008/0202191 A1 Aug. 28, 2008

(30) Foreign Application Priority Data

Dec. 27, 2006 (SE) ..... 0602813

(51) Int. Cl.
*C22C 29/06* (2006.01)
*B21C 1/00* (2006.01)
*B21D 22/20* (2006.01)

(52) U.S. Cl. ..... 75/236; 75/240; 72/274; 72/347; 72/379.4

(58) Field of Classification Search ..... 75/240; 72/274, 347, 379.4
See application file for complete search history.

(56) References Cited

U.S. PATENT DOCUMENTS

| | | | | |
|---|---|---|---|---|
| 3,215,510 | A * | 11/1965 | Kelly et al. | 75/240 |
| 5,095,730 | A | 3/1992 | Lauder | |
| 5,396,788 | A | 3/1995 | Dziedzic et al. | |
| 5,736,658 | A | 4/1998 | Mirchandani et al. | |
| 5,750,247 | A | 5/1998 | Bryant et al. | |
| 2006/0272448 | A1 | 12/2006 | Engstrom et al. | |
| 2006/0272449 | A1 | 12/2006 | Engstrom et al. | |

FOREIGN PATENT DOCUMENTS

| | | | |
|---|---|---|---|
| EP | 1 726 672 | | 11/2006 |
| EP | 1 726 673 | | 11/2006 |
| JP | 55-115944 | | 9/1980 |
| JP | 60-125348 | | 7/1985 |
| JP | 03-258424 | | 11/1991 |
| JP | 9 209123 | A | 8/1997 |
| JP | 10 029110 | A | 2/1998 |
| WO | 99/32681 | | 7/1999 |

OTHER PUBLICATIONS

International Search Report mailed May 12, 2008 issued in PCT Application No. PCT/SE2007/050956.

Office Action from related Japanese Patent Application No. 2007-158588, mailing date Jul. 27, 2010; 2 pages.

* cited by examiner

*Primary Examiner* — Roy King

*Assistant Examiner* — Ngoclan Mai

(74) *Attorney, Agent, or Firm* — Drinker Biddle & Reath LLP

(57) ABSTRACT

There is disclosed a cemented carbide tool containing tungsten carbide, titanium carbide, nickel and cobalt, molybdenum and chromium. The composition of the materials provides a good resistance to corrosion as well as high hardness and wear resistance. These properties are particularly interesting for the manufacture of tools for coldforming operations. Cold forming tools made with these materials have steady performance over a long period of time.

14 Claims, 1 Drawing Sheet

CORROSION RESISTANT TOOL

BACKGROUND OF THE INVENTION

The present invention relates to a method of making improved cemented carbide tools for shaping or otherwise working materials. The invention has particular application in making metal working tools, and specifically tools used in the manufacture of tubular casings and similar articles, such as two-piece beverage cans.

A two-piece can is made by a drawing and wall ironing process. In general, a two-piece can is made by stamping out metal discs from a metal plate. A metal "cup" is formed from the disk. The formed cups are pushed through a body-forming die comprising a plurality of annular rings, generally known as draw, redraw, and ironing rings, by a body-forming punch. The clearances between the body-forming punch and the plurality of rings become progressively smaller so that the thickness of cup wall is reduced and the cup is elongated. This process is generally referred to as the ironing operation. It is a particularly demanding operation causing high wear on the tools and is sensitive to the dimensional changes and lubrication conditions. Because of the tremendous volume of beverage cans manufactured each year, each slight improvement in the manufacturing process can result in tremendous savings.

Tools for imparting a desired shape, form, or finish to a material, such as dies, punches, and the like, are characterized by extreme hardness, compressive strength and rigidity. This is particularly necessary when shaping metals or similar materials. Commercial material working tools for mass production must also be resistant to wear, erosion and chipping from repeated and continuous stress and abrasion. In addition these tools should also exhibit good corrosion resistant properties in order not to be damaged by the surrounding liquid media (coolant/lubricant). These tools must also be made from materials which can be designed and machined to close tolerances and maintain dimensional stability over a wide range of operating conditions.

It is known to make punches, dies, deep draw tooling and similar material working tools from a variety of materials, including metals, cemented carbide and conventional ceramics. These known materials all have certain undesirable limitations. When making tools for shaping metal articles, particularly tubular casings such as two-piece beverage cans, the problems of prior known materials becomes particularly significant.

A possible way to achieve better performance in can manufacturing is the use of ceramic materials, e.g. whisker reinforced alumina or silicon nitride as are disclosed in U.S. Pat. No. 5,095,730 and U.S. Pat. No. 5,396,788 respectively, but so far conventional cemented carbide seems to keep its position as the preferred material.

A second possible way to achieve better performance is the use of ultrafine grained cemented carbide. Many improvements could be reached by a grain size reduction leading to better wear resistance as described in EP-A-1726672.

Slightly better corrosion resistance is expected from ultrafine material as also described in EP-A-1726673. However, this improvement is believed to be a result of thinner binder films obtained via the WC grain size reduction. Thus, even if a slight improvement is reached, the leaching mechanism will not be drastically modified, leading to binder elimination with a consequent destruction of the cemented carbide structure.

OBJECTS AND SUMMARY OF THE INVENTION

It is, thus, an object of the present invention to provide a tool for coldforming and drawing operations particularly in the manufacture of two-piece beverage aluminum or steel cans by the use of corrosion resistant cemented carbide grade giving better properties than prior art tools particularly for the ironing operation.

In one embodiment of the invention, there is provided a cemented carbide tool for deep drawing and ironing operations in the manufacturing of aluminium or steel consisting essentially of, in wt %, from about 80 to about 90 WC, from about 5 to about 15 TiC and from about 5 to about 10 of the sum of Ni, Mo, Cr and Co in the following amounts in wt-%: from about 40 to about 60 Ni, less than about 20 Mo, from about 15 to about 40 Cr and with a sub-stoichiometric carbon content giving from about 1 to about 10 vol-% eta-phase evenly distributed as little stars less than about 50 μm, of very fine grains less than about 1 μm.

In another embodiment of the present invention, there is provided the use of the above-described cemented carbide tool for the manufacture of beverage cans, dry cell battery casings and aerosol cans.

In still another embodiment of the present invention, there is provided the use of the above-identified cemented carbide tool for the drawing operation of steel wire.

DETAILED DESCRIPTION OF THE PREFERRED EMBODIMENTS

Figure 1:
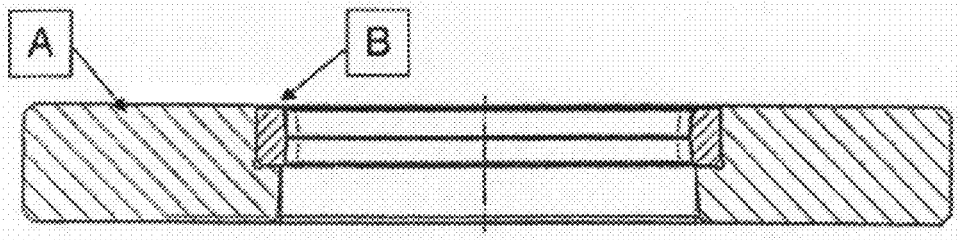
FIG. 1 shows an ironing die in which A=cemented carbide die and B=steel casing.

The present invention relates to the use a specific binder design to get very good corrosion resistance of the cemented carbide against the coolant/lubricant used in the field. The cemented carbide exhibits a high hardness in order to reach a high wear resistance. This is obtained via the complex hard phase that contains tungsten carbide and titanium carbide. The cemented carbide contains tungsten carbide, titanium carbide, nickel, molybdenum and chromium. This composition of the cemented carbide provides good resistance to corrosion as well as a high hardness and wear resistance as shown by Example 1. The combination of a complex hard phase and corrosion resistant binder leads to the desired better properties represented by an 8% binder grade having hardness about 1930 HV30, i.e., higher hardness than the commonly used 6% Co binder grade that typically has a hardness of 1775 HV30.

The cemented carbide used in the invention consists essentially of, in wt %, from about 80 to about 90 WC, from about 5 to about 15 TiC and from about 5 to about 10, preferably from about 7 to about 10, of the sum of Ni, Mo, Cr and Co in the following amounts, also in wt-%: from about 40 to about 60, preferably from about 45 to about 55, Ni or (Ni+Co), less than about 20, preferably from about 10 to about 18 Mo, from about 15 to about 40, preferably from about 30 to about 40 Cr.

Up to about 30 wt % of the (Ni+Co) can be Co. The carbon content is preferably sub-stoichiometric. In certain embodiments of the invention, the sole components of the cemented carbide are those listed above, along with any normal minor impurities.

The cemented carbide structure comprises:

WC with a grain size of less than about 2, preferably from about 1 to about 2, μm, from about 1 to about 10, preferably from about 5 to about 7, vol-% eta-phase evenly distributed as little stars less than about 50 μm, preferably less than about 25 μm, of very fine grains less than about 1 μm, and gamma phase of size from about 2 to about 3 μm, appears rounded and with grey colour in a light optical picture.

The material has a hardness of 1870-2000 HV30.

The cemented carbide used in the present invention is prepared from powders forming the hard constituents and powders forming the binder are wet milled together, dried, pressed to bodies of desired shape and sintered. The powder mixture should preferably have such a carbon content to give an eta-phase content of the sintered bodies according to above.

Thus the invention relates to the use of cemented carbide with complex hard phase and corrosion resistant binder ending to high hardness, improved wear and corrosion resistance in coldforming and drawing operations particularly in the ironing process of aluminium and steel beverage can manufacturing. However the invention has broad applicability for use in manufacturing a variety of other shaped articles, particularly tubular casings, such as dry cell battery casings and aerosol cans. The invention also applies to the use of the cemented carbide according to the invention particularly for other coldforming and drawing operations such as the drawing operation of wire and especially tire cord.

The invention is additionally illustrated in connection with the following examples, which are to be considered as illustrative of the present invention. It should be understood, however, that the invention is not limited to the specific details of the examples.

EXAMPLE 1

Two cemented carbide bodies with the composition according to the table below, in weight % were prepared and characterized.

| Ref<br>Sample | A<br>invention | B<br>prior art |
|---|---|---|
| WC | 83.3 | 93.73 |
| TiC | 8.65 | 0 |
| Co | 0 | 6 |
| Ni | 4 | 0 |
| Mo | 1.15 | 0 |
| Cr | 2.9 | 0.27 |
| d WC μm | 1.2 | 0.8 |

Figure 2:
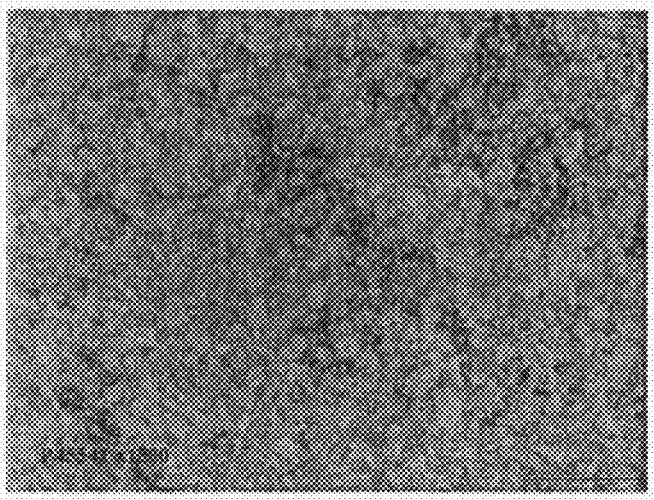
FIG. 2 shows in 1500 times magnification in light optical microscope the cemented carbide used according to the present invention. The scale bar is 10 μm. The microstructure is etched by Murakami solution. Eta phase is black, gamma phase of size 2 to 3 μm is rounded and grey and WC is fine <2 μm with angular shape and grey.
Figure 3:
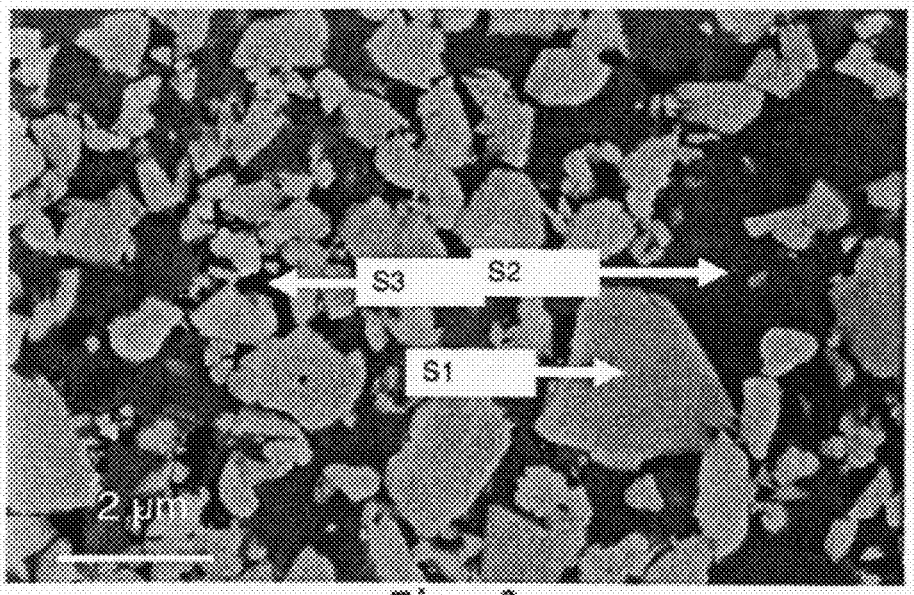
FIG. 3 is a picture of the microstructure in higher resolution by SEM 10000× magnification in which S1 is WC, S2 gamma phase and S3 eta phase.

The microstructure of the tool according to the invention, ref A, is shown in FIGS. 2 and 3. The micrographs show the carbide phases WC, the gamma phase (TiC-based) and the fine eta phase. Prior art, B, is Sandvik's standard grade for ironing operation.

The properties have been measured according to the standard used in the cemented carbide field i.e., ISO 3878:1983 for the hardness and ATM B611-85 for the abrasion wear resistance.

The corrosion resistance has been characterized using an immersion test in a real lubricant formulation (used for body maker) diluted in at 3 wt % in demineralized water. The immersion has been performed during 15 days at 50° C., which correspond to the lubricant temperature during the drawing process. The weight of the cemented carbide sample was measured before and after the immersion. Very fine SEM observations were carried out with the Scanning Electron Microscope equipped with a Field Emission Gun (FEG-SEM) in order to confirm if the some binder has been removed from the surface after the test.

The results are presented in the table below:

| Ref<br>Sample | A<br>invention | B<br>prior art |
|---|---|---|
| Hardness (HV30) | 1930 | 1775 |
| Wear resistance($cm^{-3}$) | 98 | 66 |
| Weight evolution (mg) | +1 | −5 |
| Leaching of the binder (SEM) | no | yes |

Thus, compared to prior art, the invention exhibits 8.7% higher hardness, 48.5% higher wear resistance and a much better corrosion resistance as no leaching of the binder has been observed.

EXAMPLE 2

In the deep drawing operation of beverage cans the ironing rings (see FIG. 1) are subject to wear causing surface destruction, leading to change of the friction forces in the ironing operation. Ironing rings of composition A and B according to Example 1 were produced and tested in a can forming operation under normal drawing conditions. The force was measured on the third ironing ring. The evolution of the force with time was recorded for each test ring. The slope of the curve of Force vs Time is evaluated for each ring. The average results of the grades are compared and used as a measure of the performance. The results of the test are given in the table below.

| Grade | Slope Force vs Time | Average slope Force vs Time |
|---|---|---|
| A (Invention) | 0.17 0.20 0.08 | 0.15 |
| B (Prior art) | 0.26 0.26 | 0.26 |

Difference of slope between grade A (Invention) and slope of B (Prior art) expressed as percent

| | |
|---|---|
| Average: | −42% |
| Min: | −23% |
| Max: | −69% |

Thus the grade according to the invention exhibits better performance in the ironing operation than the prior art grade.

Although the present invention has been described in connection with preferred embodiments thereof, it will be appreciated by those skilled in the art that additions, deletions, modifications, and substitutions not specifically described may be made without department from the spirit and scope of the invention as defined in the appended claims.

The invention claimed is:

1. A cemented carbide tool for deep drawing and ironing operations consisting essentially of, in wt %: from about 80 to about 90 WC, from about 5 to about 15 TiC and from about 5 to about 10 of the sum of Ni, Mo, Cr and Co in the following amounts in wt-%: from about 40 to about 60 Ni or (Ni+Co), less than about 20 Mo, from about 15 to about 40 Cr and with a sub-stoichiometric carbon content giving from about 1 to about 10 vol-% eta-phase evenly distributed as little stars less than about 50 μm, of very fine grains less than about 1 μm.

2. The cemented carbide tool of claim 1 in which up to 30 wt % of the (Ni+Co) is Co.

3. The cemented carbide tool of claim 1 where the sum of Ni, Mo, Cr and Co is from about 7 to about 10 wt % in the following amounts in wt %: from about 45 to about 55 Ni or (Ni+Co), from about 10 to about 18 Mo, from about 30 to about 40 Cr.

4. The cemented carbide tool of claim 1 with a grain size of WC of from about 1 to about 2 μm, having an eta-phase of from about 5 to about 7 vol %, with the eta-phase evenly distributed as little stars less than about 25 μm.

5. A method of manufacturing beverage cans, the method comprising deep drawing and ironing aluminum or steel with the cemented carbide tool of claim 1.

6. A method of manufacturing tubular casings, the method comprising forming a shape of the tubular casing with the cemented carbide tool of claim 1.

7. A method of manufacturing a steel wire, the method comprising drawing the steel wire through the cemented carbide tool of claim 1.

8. The method according to claim 7 in which up to 30 wt % of Ni is replaced by Co.

9. The method according to claim 7 wherein said steel wire is steel tire cord wire.

10. The method of claim 6, wherein the tubular casing is a dry cell battery casing.

11. The method of claim 6, wherein the tubular casing is an aerosol can.

12. The cemented carbide tool of claim 1, wherein the tool is a punch.

13. The cemented carbide tool of claim 1, wherein the tool is a wire die.

14. The cemented carbide tool of claim 1, wherein the tool is a deep drawing tool.

* * * * *